United States Patent [19]

Schieber et al.

[11] 4,004,437

[45] Jan. 25, 1977

[54] FLAT KNITTING MACHINE

[75] Inventors: Hans Schieber, Bopfingen; Franz Radl, Westhausen; Erich Krause, Bopfingen; Reinhold Schimko, Wasseralfingen, all of Germany

[73] Assignee: Universal Maschinenfabrik Dr. Rudolf Schieber KG, Westhausen, Germany

[22] Filed: Apr. 8, 1976

[21] Appl. No.: 675,089

[30] Foreign Application Priority Data

Apr. 9, 1975 Germany ..... 2515521

[52] U.S. Cl. ..... 66/78; 66/71; 66/77

[51] Int. Cl.[2] ..... D04B 7/00; D04B 15/36; D04B 35/00

[58] Field of Search ..... 66/78, 54, 71, 77

[56] References Cited

UNITED STATES PATENTS

| | | | |
|---|---|---|---|
| 3,766,754 | 10/1973 | Schieber et al. | 66/78 |
| 3,771,329 | 11/1973 | Krause | 66/78 |
| 3,779,044 | 12/1973 | Schieber et al. | 66/78 |
| 3,789,630 | 2/1974 | Schieber | 66/78 |

*Primary Examiner*—Ronald Feldbaum
*Attorney, Agent, or Firm*—Sughrue, Rothwell, Mion, Zinn & Macpeak

[57] ABSTRACT

A flat knitting machine comprises a needle bed and a carriage traversible along the needle bed. Stitch cams presettable in a plurality of different positions according to a desired knitting pattern are provided, and an adjustably positioned ramp in the needle bed fixed to a slide is adapted to displace a cooperating stitch cam into a selected position. Means are provided on the carriage for clamping the stitch cam in the position to which it has been displaced by the ramp and a slide to which the ramp is attached is raisable by control cam means preceding knitting cams in the carriage.

8 Claims, 7 Drawing Figures

FLAT KNITTING MACHINE

Figure 1:
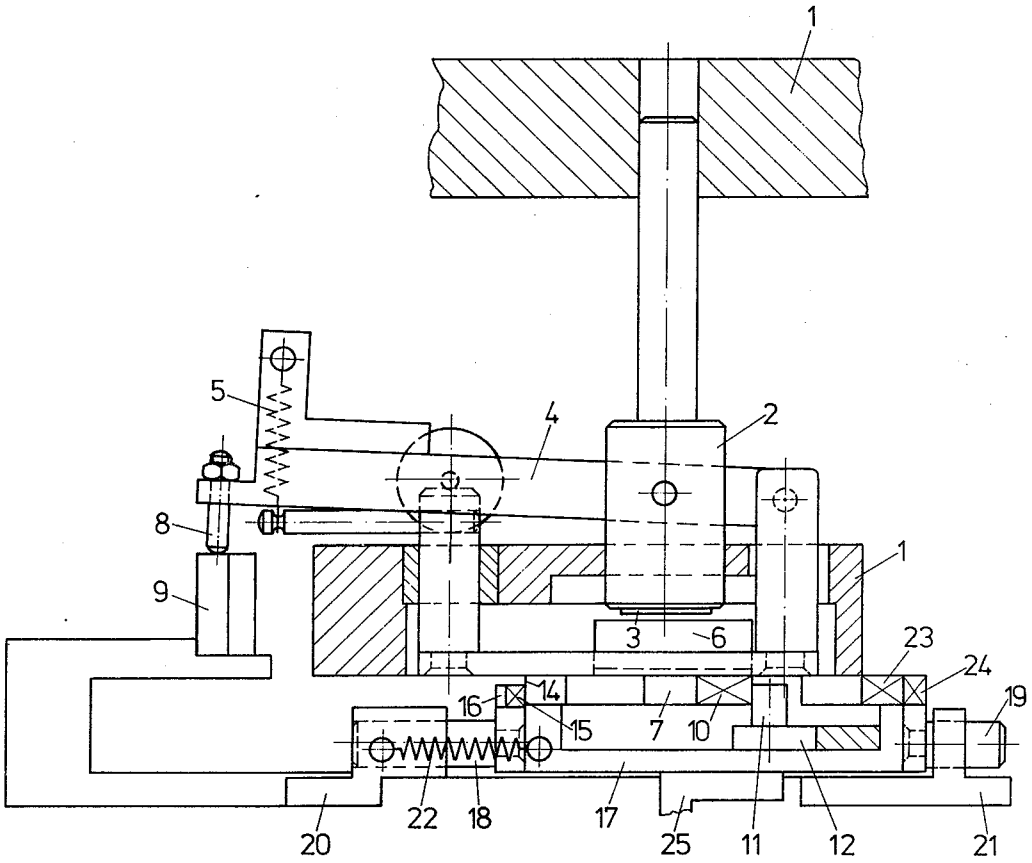

The invention relates to a flat knitting machine including a needle bed, a carriage traversible along the needle bed, stitch cams which can be preset in a plurality of different positions according to a desired pattern, at least one ramp in the needle bed fixed to a slide and adapted to displace the cooperating stitch cam into a selected position, means in the carriage for clamping the stitch cam in the position into which it has been displaced by the ramp, the position of said ramp being adjustable by a plurality of independently pre-adjustable set screws.

A flat knitting machine of this kind has been disclosed in the German Patent Specification No. 2 111 803. In the flat knitting machine therein described the stitch length adjusting mechanism is located outside the cam carriage on each side of the machine. A draw cam or stitch cam rides over a pre-adjustable ramp forming part of the stitch length adjusting mechanism and remains clamped in its adjusted position. The ramp itself is adjusted by a pawl and adjusting blades by means of set screws, the ramp being displaceable into defined positions controlled by the setting of the set screws and blades. Adjustment by means of a pawl limits the possibilities of adjustment because of the shortness of the setting step which prevents rapid adjustment for instance between one cam system to another on the same carriage because it may be desired to move the pawl a number of steps. In a variant of this known flat knitting machine the setting of the cam is performed by means of an electric motor which is itself controlled by an electronic system. However, control of the motor is relatively complex and also rather slow.

Based on the above-described known flat knitting machine, the object of the present invention is to provide a flat knitting machine in which the stitch cams can be mechanically reset reliably and quickly even in carriages containing several cam systems, and in which preselection of the desired setting height can be accomplished in a simple way.

According to the invention this object is achieved by the provision of a flat knitting machine comprising a needle bed, a carriage traversible along the needle bed, stitch cams which can be preset in a plurality of different positions according to a desired pattern, at least one ramp in the needle bed fixed to a slide and adapted to displace the cooperating stitch cam into a selected position, means in the carriage for clamping the stitch cam in the position into which it has been displaced by the ramp, wherein the position of said ramp is adjustable by a plurality of independently pre-adjustable set screws, a slide to which the ramp is attached is raisable by control cam means preceding knitting cams in the carriage, independently pre-adjustable set screws limit the return motion of the slide, and set screw means cooperate with separately controllable intercepting stop levers working in slots.

By raising the slide with the aid of a control cam and providing stops in the form of intercepting levers the need for operating a pawl in several steps along a major longitudinal path length in the machine does not arise. The stop levers can be quickly operated and major changes in the position of the stitch cam can be quickly effected. The invention therefore also permits the adjustment of the stitch cams to be accomplished in machines containing multiple cam systems in the carriage, and with the aid of only one single stitch length adjusting mechanism. The difficulties which were in the past encountered when consecutive cam systems had to be adjusted for different stitch lengths, particularly when a trailing stitch cam was required to produce slacker stitches, are all overcome in the present machine.

Conveniently each of the stop levers may be associated with a solenoid for operating the same, the solenoids moving the required stop lever underneath the associated set screw when the slide is raised, so that the stitch cam will then be adjusted according to this selected setting.

In order to increase the number of available settings without the need for undue complications the shortest length set screw is preferably accociated with a fixed stop, an arrangement which saves one controllable stop lever and its solenoid.

It is preferred to make the set screws, which are disposed consecutively in a row, long and short in alternation and to stagger the associated stops according to the length of the screws. This feature enables the entire stitch length adjusting mechanism including its acutating solenoids to be very compactly designed by disposing the solenoids in two banks.

In order to ensure that the stitch cam will maintain reliable contact with the ramp during the process of adjustment, the stationary stitch length adjusting mechanism is preferably provided with a spring-loaded lever working about a fixed fulcrum and provided with a stud adapted to keep the working face of the stitch cam in contact with the ramp.

With a view to further simplifying the setting of the set screws and hence the different possible adjustments of the stitch cam, scales and pointers may be provided at the front end of the machine to indicate the settings of the slides associated with the front and back needle beds. It is preferred to provide gear wheels mounted in the longitudinal axis of the flat knitting machine, linkages and racks, for transmitting the position of the slides to the pointers. When the set screws are adjusted the selected setting of the screws for the slides associated with the front and back needle beds can thus be conveniently read at the front end of the knitting machine.

Finally, in order to provide a satisfactory engagement between racks and their gear wheels without backlash the racks are preferably pivotally attached to their associated link rods and kept in mesh with the gear wheels by tension springs suspended between the racks and their link rods.

Figures 2, 3, 4:
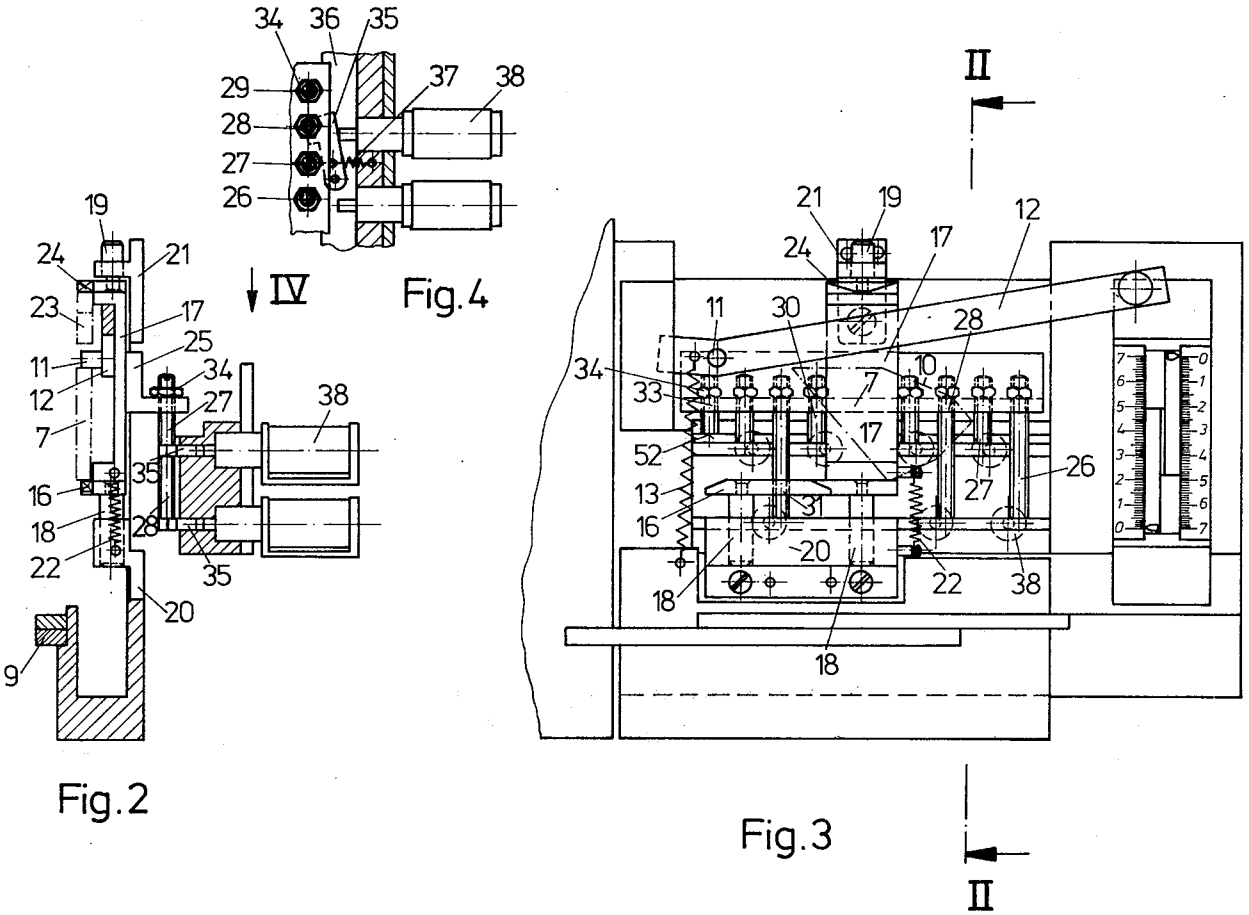
Figure 6:
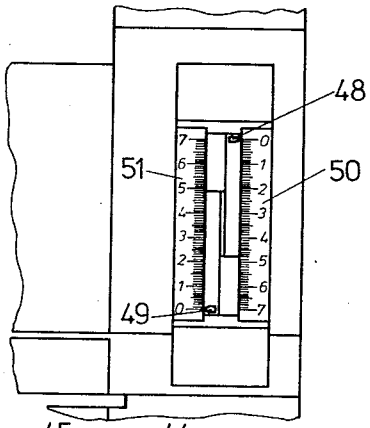
Figure 7:
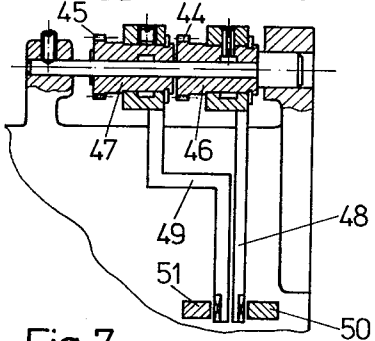
Figure 5:
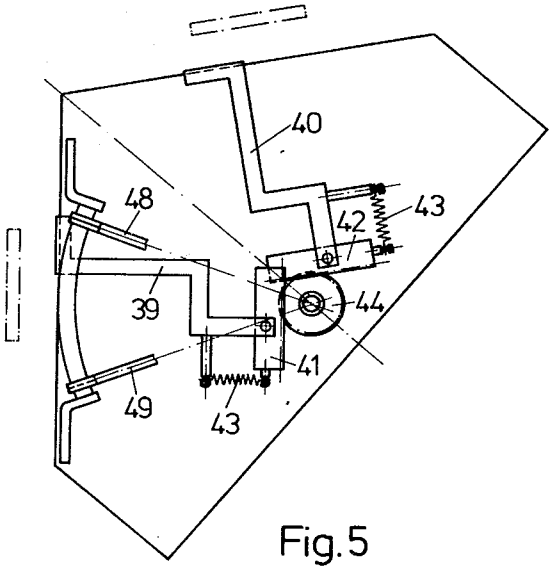

A preferred example of the invention is illustravely shown in the drawing and will now be described in greater detail. In the drawing:

FIG. 1 is a cross-section of a flat knitting machine embodying the invention, the section being taken through a stitch length adjusting mechanism which is fixed in the machine frame, and through a carriage comprising a stitch cam which has been released by its clamping means, FIG. 2 is a section of the stitch length adjusting mechanism and associated control means, taken along the line II—II in FIG. 3, FIG. 3 is a view of the stitch length adjusting mechanism according to FIG. 2 from above, FIG. 4 is a cross-section of the stitch length adjusting mechanism according to FIG. 2, seen in the direction of arrow IV in FIG. 2, FIG. 5 is a section of the needle beds in the region where an arrangement is provided for indicating the existing settings of the stitch length adjusting mechanism, FIG. 6 is a view of the scales of the indicating means according to FIG. 5, and FIG. 7 is a longitudinal section of the indicating means according to FIG. 5.

Referring to FIG. 1 a frame 1 of the knitting machine carriage which is adapted to traverse the needle beds of the knitting machine is shown only fragmentally in a position above a stitch length adjusting mechanism. Mounted in the carriage frame 1 is a clamping member 2. A disc 3 on the clamping member 2 is urged by a spring 5 attached to a lever 4 against a slide 6 of a draw or stitch cam 7 to prevent the stitch cam 7 from being displaced whilst the carriage travels along the needle beds. In FIG. 1 a pin 8 on the lever 4 has mounted a ramp 9 affixed to the knitting machine bed adjacent the stitch length adjusting mechanism. The ramp 9 operates to raise the lever 4 which consequently releases the slide 6 of the stitch cam 7. In this position of the clamping member 2 the stitch cam 7 is free to move.

Further, with reference to FIGS. 1 to 3 it will be understood that when the carriage crosses the stitch length adjusting mechanism a chamfered face 10 on the stitch cam 7 will ride across an actuating pin 11 on a lever 12. A spring 13 biasses underside 14 of the stitch cam 7 against an inclined face 15 on a ramp 16.

The ramp 16 is part of a slide 17 which is displaceable in a direction normal to the direction of traverse of the carriage. The slide 17 is provided with pins 18 and 19 which are axially slidably movable in bearings 20 and 21, a spring 22 pulling this slide in a downward direction.

The carriage, which is not illustrated in detail, is provided, preceding each of a plurality of cam systems, i.e. also between neighbouring consecutive cam systems, with a sloping cam face 23. During carriage traverse all these cam faces 23, on passing across the stitch length adjusting mechanism, come into sliding engagement with a cam face 24 on the slide 17 and lift it into its uppermost position against the pull of the spring 22. This simultaneously causes the ramp 16 to be lifted into its fully raised position.

Also affixed to the slide 17 is an angle piece 25 in which set screws 26 to 33 of different lengths are mounted so that these are lifted and lowered together with the slide 17. These screws 26 to 33 are adjustable for the preselection of different stitch length settings and they can be clamped in their selected positions by clamping nuts 34.

Referring to FIGS. 2 and 4 it will be understood that each of the set screws 26 to 32 is associated with a stop lever 36 which yieldingly moves in a slog 36. Each stop lever 36 is pulled into the slot 36 by an associated spring 37. The set screw 33, however, is associated with a fixed stop 52, as shown in FIG. 3, instead of with a stop lever 35.

Each stop lever 35 is associated with a solenoid 38 actuated by a control system of the machine to force the lever 35 far enough out of its slot 36 for the set screws 26 to 32 associated with that stop lever 36 to be intercepted by the stop lever 36 when the slide 17 drops upon reaching the end of the cam face 23. The cooperation of the set screws 26 to 32 with their associated stop levers 36 and the cooperation of the set screw 33 with its fixed stop 52 determine the adjustment of the stitch cam in the cam system concerned.

Since eight set screws 26 to 33 are provided in the stitch cam adjusting mechanism illustrated in FIGS. 1 to 4, eight different positions of the stitch cam 7 for adjusting the tightness of the knitting are preselectable by the machine control system with the aid of the solenoids 38. As already mentioned, in the case of knitting machine carriages provided with several cam systems, cams 23 are provided on such a carriage between each two neighbouring knitting cam systems so that the trailing stitch cam 7 is independently adjustable and only one stitch length control mechanism is needed on each side of the flat knitting machine.

The set screws 26 to 33 which are situated in a row are arranged alternately long and short screws, thus permitting the associated solenoids 38 for actuating the stop levers 35 to be disposed in two relatively staggered banks and the set screws 26 to 33 themselves to be placed closely packed together side by side.

FIGS. 5 to 7 illustrate an arrangement associated with the stitch length control system for indicating the existing settings of the set screws 26 to 33. A respective slide 17 is associated with the front and rear needle beds. The pre-adjusted positions of the set screws 26 to 33 are transmitted by rods 39 and 40 attached to the slide 17 and by racks 41 and 42 to gear wheels 44 and 45 mounted in the longitudinal axis of the machine. In order to ensure that the racks 41 and 42 and the gear wheels 44 and 45 work without backlash, the racks 41 and 42 are pivotably attached to the rods 39 and 40 and are urged into mesh with the gear wheels 44 and 45 by springs 43 disposed between the links 39 and 40 and the racks 41 and 42.

As will be understood by reference to FIG. 7 the gear wheels 44 and 45 are provided with hubs 46 and 47 which carry pointers 48 and 49. At the front of the flat knitting machine, as shown in FIG. 6, there are two sets of scales 50 and 51 across which the pointers 48 and 49 are adapted to move. Scale 50 gives readings of the settings of the stitch cams 7 in the cam systems associated with the front needle beds, whereas scale 51 provides readings for the settings of the stitch cams 7 in the cam systems associated with the back needle bed. The readings on the scales 50 and 51 are geared up a number of times.

Having now described the invention, it is to be understood that modifications and alternations may be made within the scope of the following claims.

We claim:

1. A flat knitting machine comprising a needle bed, a carriage traversible along the needle bed, stitch cams which can be preset in a plurality of different positions according to a desired pattern, at least one ramp in the needle bed fixed to a slide and adapted to displace the cooperating stitch cam into a selected position, means in the carriage for clamping the stitch cam in the position into which it has been displaced by the ramp, wherein the position of said ramp is adjustable by a plurality of independently pre-adjustable set screws, a slide to which the ramp is attached is raisable by control cam means preceding knitting cams in the carriage, independently pre-adjustable set screws limit the return motion of the slide, and set screw means cooperate with separately controllable intercepting stop levers working in slots.

2. A flat knitting machine as claimed in claim 1, in which each stop lever is operable by a respective solenoid.

3. A flat knitting machine as claimed in claim 1, in which a shortest of the set screws cooperates with a fixed stop.

4. A flat knitting machine as claimed in claim 1, in which successive set screws are long and short in alternation, and the associated stops are staggered according to the different lengths of the set screws.

5. A flat knitting machine as claimed in claim 1, in which a spring-loaded lever working on a stationary fulcrum is provided with a deflecting means for displacing the stitch cam to maintain its working face in contact with the ramp.

6. A flat knitting machine as claimed in claim 1, including, at a front end of the machine, scales and pointers indicating the settings of the slides associated with front and back needle beds.

7. A flat knitting machine as claimed in claim 6, in which gear wheels mounted in the longitudinal axis of the flat knitting machine, linkage and racks are provided for transmitting the position of the slides.

8. A flat knitting machine as claimed in claim 7, in which the racks are pivotally attached to their associated link rods and kept in mesh with the gear wheels by springs extending between the racks and the link rods.

* * * * *